US011300313B2

(12) United States Patent
Zhuo et al.

(10) Patent No.: US 11,300,313 B2
(45) Date of Patent: Apr. 12, 2022

(54) COOLING MEDIUM CONTROL METHOD FOR MULTI-CONNECTED AIR CONDITIONING SYSTEM

(71) Applicants: Qingdao Haier Air-conditioning Electronic Co., Ltd, Shandong (CN); Haier Smart Home Co., Ltd., Shandong (CN)

(72) Inventors: Baitian Zhuo, Qingdao (CN); Bin Shi, Qingdao (CN); Shaojiang Cheng, Qingdao (CN); Ruigang Zhang, Qingdao (CN); Jun Wang, Qingdao (CN)

(73) Assignees: QINGDAO HAIER AIR-CONDITIONING ELECTRONIC CO., LTD, Qingdao (CN); HAIER SMART HOME CO., LTD., Qingdao (CN)

( * ) Notice: Subject to any disclaimer, the term of this patent is extended or adjusted under 35 U.S.C. 154(b) by 35 days.

(21) Appl. No.: 16/961,398

(22) PCT Filed: May 21, 2019

(86) PCT No.: PCT/CN2019/087814
§ 371 (c)(1),
(2) Date: Jul. 10, 2020

(87) PCT Pub. No.: WO2020/164203
PCT Pub. Date: Aug. 20, 2020

(65) Prior Publication Data

US 2021/0239352 A1 Aug. 5, 2021

(30) Foreign Application Priority Data

Feb. 14, 2019 (CN) ..... 201910114631.9

(51) Int. Cl.
*F24F 11/84* (2018.01)
*F24F 11/64* (2018.01)

(52) U.S. Cl.
CPC ..... *F24F 11/84* (2018.01); *F24F 11/64* (2018.01)

(58) Field of Classification Search
CPC .. F24F 11/84; F24F 11/64; F24F 11/30; F25B 2600/2513
See application file for complete search history.

(56) References Cited

U.S. PATENT DOCUMENTS 4,888,957 A * 12/1989 Chmielewski ..... F25B 41/31 62/84
5,600,962 A * 2/1997 Aizawa ..... F24F 3/065 62/204

(Continued)

FOREIGN PATENT DOCUMENTS

JP 2004020064 A * 1/2004

*Primary Examiner* — Nelson J Nieves
(74) *Attorney, Agent, or Firm* — Maier & Maier, PLLC

(57) ABSTRACT

To control operating parameters of the compressor and ensure stable operation of the air conditioning system, a cooling medium control method for a multi-connected air conditioning system includes: acquiring current operating values of target parameters of the compressor during the operation of the compressor; calculating deviation degrees of the target parameters of the compressor according to the current operating values of the target parameters of the compressor and standard operating ranges of the target parameters of the compressor; and selectively adjusting an opening degree of the outdoor expansion valve or the indoor expansion valve based on the deviation degrees; where the standard operating ranges of the target parameters are operating ranges of the target parameters specified by a normal operating state of the compressor. Here the opening degree (Continued)

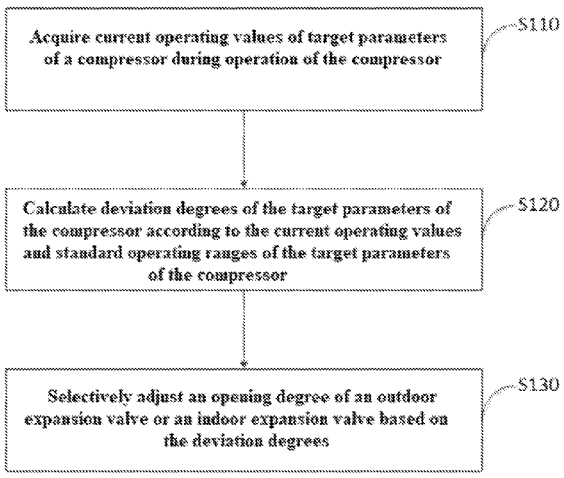

of the indoor expansion valve or the outdoor expansion valve is adjusted in real time according to parameters of the compressor.

9 Claims, 1 Drawing Sheet

(56) References Cited

U.S. PATENT DOCUMENTS

| | | | | |
|---|---|---|---|---|
| 10,107,537 | B2 * | 10/2018 | Ishimura | F25B 31/006 |
| 2002/0002834 | A1 * | 1/2002 | Kuroki | F25B 41/31 62/238.6 |
| 2008/0022706 | A1 * | 1/2008 | Sakimichi | F25B 1/10 62/190 |
| 2010/0043467 | A1 * | 2/2010 | Kawano | F25B 49/02 62/129 |
| 2011/0132011 | A1 * | 6/2011 | Kojima | F24F 11/77 62/180 |
| 2011/0314848 | A1 * | 12/2011 | Tanaka | F25B 13/00 62/126 |
| 2015/0300714 | A1 * | 10/2015 | Ishimura | F25B 41/26 62/225 |
| 2018/0058740 | A1 * | 3/2018 | Nishiyama | F25B 13/00 |
| 2018/0149397 | A1 * | 5/2018 | Wolgamot | F25B 41/20 |
| 2018/0283756 | A1 * | 10/2018 | Avila Chillida | F25B 49/043 |
| 2019/0049154 | A1 * | 2/2019 | Ikeda | F25B 31/004 |
| 2020/0200454 | A1 * | 6/2020 | Okano | F25B 49/02 |

* cited by examiner

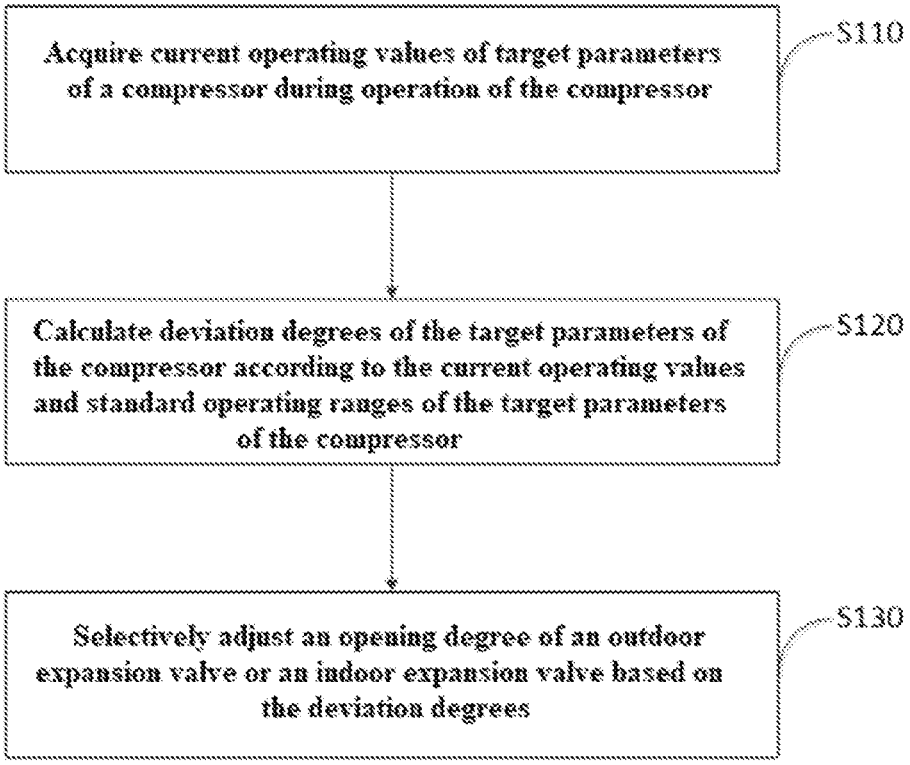
Acquire current operating values of target parameters of a compressor during operation of the compressor
S110
Calculate deviation degrees of the target parameters of the compressor according to the current operating values and standard operating ranges of the target parameters of the compressor
S120
Selectively adjust an opening degree of an outdoor expansion valve or an indoor expansion valve based on the deviation degrees
S130

COOLING MEDIUM CONTROL METHOD FOR MULTI-CONNECTED AIR CONDITIONING SYSTEM

FIELD

The present disclosure belongs to the technical field of air conditioning, and particularly relates to a cooling medium control method for a multi-connected air conditioning system.

BACKGROUND

In an air conditioning system, a cooling medium refers to a working substance that continuously circulates and achieves cooling/heating through a change of its own state; namely, it absorbs/releases heat in an indoor heat exchanger to gasify/liquefy, and in an outdoor heat exchanger, it transfers heat to the surrounding environment/absorbs heat from the surrounding environment to liquefy/gasify. In a multi-connected air conditioning system, an outdoor unit is usually connected to a plurality of indoor units, and cooling medium is often added according to the length of a pipeline installed on the site. The added amount of cooling medium is often simply calculated based on the diameter and length of the pipe.

At present, a circulation amount of the cooling medium is typically adjusted by expansion valves. For example, an opening degree of an indoor expansion valve is adjusted during cooling, and an opening degree of an expansion valve of the outdoor unit is adjusted during heating. However, the circulation amount of the cooling medium required by the air conditioning system is often related to the temperature environment where the air conditioning system is located, the number of running units and the like. Too much or too little cooling medium circulation will both affect the cooling/heating effect of the air conditioning system. Once a normal operating range of the compressor is exceeded, it will also cause damage to the compressor.

Therefore, the present disclosure proposes a new cooling medium control method for a multi-connected air conditioning system to control operating parameters of the compressor and ensure a stable and reliable operation of the air conditioning system.

SUMMARY

In order to solve the above-mentioned problems in the related art, namely, to control operating parameters of a compressor and ensure the stable and reliable operation of an air conditioning system, the present disclosure proposes a cooling medium control method for a multi-connected air conditioning system, wherein the multi-connected air conditioning system includes a compressor, an outdoor unit, and a plurality of indoor units connected to the outdoor unit, the outdoor unit including an outdoor expansion valve, and each of the indoor units including an indoor expansion valve; the cooling medium control method includes the following steps: S110. acquiring current operating values of target parameters of the compressor during the operation of the compressor; S120. calculating deviation degrees of the target parameters of the compressor according to the current operating values of the target parameters of the compressor and standard operating ranges of the target parameters of the compressor; and S130. selectively adjusting an opening degree of the outdoor expansion valve or the indoor expansion valve based on the deviation degrees; wherein the standard operating ranges of the target parameters are operating ranges of the target parameters specified by a normal operating state of the compressor.

In a preferred embodiment of the above cooling medium control method for the multi-connected air conditioning system, in step S110, the target parameters include a high pressure of the compressor, and the current operating value of the high pressure is Pd; and in step S120, when $Pd_{lower\ limit} \leq Pd \leq Pd_{upper\ limit}$, a deviation degree $D_{pd}$ of the high pressure Pd is 0; when $Pd > Pd_{upper\ limit}$, the deviation degree $D_{pd}$ of the high pressure Pd is calculated according to the following formula: $D_{pd} = Pd_{upper\ limit}/Pd - 1$; and when $Pd < Pd_{lower\ limit}$, the deviation degree $D_{pd}$ of the high pressure Pd is calculated according to the following formula: $D_{pd} = Pd_{lower\ limit}/Pd - 1$; wherein $Pd_{upper\ limit}$ is a maximum value in the standard operating range of the high pressure, and $Pd_{lower\ limit}$ is a minimum value in the standard operating range of the high pressure.

In a preferred embodiment of the above cooling medium control method for the multi-connected air conditioning system, in step S110, the target parameters further include a low pressure of the compressor, and the current operating value of the low pressure is Ps; and in step S120, when $Ps_{lower\ limit} \leq Ps \leq Ps_{upper\ limit}$, a deviation degree $D_{ps}$ of the low pressure Ps is 0; when $Ps > Ps_{upper\ limit}$, the deviation degree $D_{ps}$ of the low pressure Ps is calculated according to the following formula: $D_{ps} = Ps_{upper\ limit}/Ps - 1$; and when $Ps < Ps_{lower\ limit}$, the deviation degree $D_{ps}$ of the low pressure Ps is calculated according to the following formula: $D_{ps} = Ps_{lower\ limit}/Ps - 1$; wherein $Ps_{upper\ limit}$ is a maximum value in the standard operating range of the low pressure, and $Ps_{lower\ limit}$ is a minimum value in the standard operating range of the low pressure.

In a preferred embodiment of the above cooling medium control method for the multi-connected air conditioning system, in step S110, the target parameters further include a compression ratio of the compressor, and the compression ratio compRate=(Pd+1)/(Ps+1); and in step S120, when $C_{lower\ limit} < compRate\ C_{upper\ limit}$, a deviation degree $D_c$ of the compression ratio is 0; when $compRate > C_{upper\ limit}$, the deviation degree $D_c$ of the compression ratio is calculated according to the following formula: $D_c = C_{upper\ limit}/compRate - 1$; and when $compRate < C_{lower\ limit}$, the deviation degree $D_c$ of the compression ratio is calculated according to the following formula: $D_c = C_{lower\ limit}/compRate - 1$; wherein $C_{upper\ limit}$ is a maximum value in the standard operating range of the compression ratio, and $C_{lower\ limit}$ is a minimum value in the standard operating range of the compression ratio.

In a preferred embodiment of the above cooling medium control method for the multi-connected air conditioning system, in step S110, the target parameters further include an exhaust superheat degree of the compressor, and the current operating value of the exhaust superheat degree is Td; and in step S120, when $Td_{lower\ limit} \leq Td \leq Td_{upper\ limit}$, a deviation degree $D_{Td}$ of the exhaust superheat degree Td is 0; when $Td > Td_{upper\ limit}$, the deviation degree $D_{Td}$ of the exhaust superheat degree Td is calculated according to the following formula: $D_{Td} = Td/Td_{upper\ limit} - 1$; and when $Td < Td_{lower\ limit}$, the deviation degree $D_{Td}$ of the exhaust superheat degree Td is calculated according to the following formula: $D_{Td} = Td/Td_{lower\ limit} - 1$; wherein $Td_{upper\ limit}$ is a maximum value in the standard operating range of the exhaust superheat degree, and $Td_{lower\ limit}$ is a minimum value in the standard operating range of the exhaust superheat degree.

In a preferred embodiment of the above cooling medium control method for the multi-connected air conditioning system, in step S110, the target parameters further include an oil temperature superheat degree of the compressor, and the current operating value of the oil temperature superheat degree is Toil; and in step S120, when $Toil_{lower\ limit} \leq Toil \leq Toil_{upper\ limit}$, a deviation degree $D_{Toil}$ of the oil temperature superheat degree Toil is 0; when $Toil > Toil_{upper\ limit}$, the deviation degree $D_{Toil}$ of the oil temperature superheat degree Toil is calculated according to the following formula: $D_{Toil} = Toil/Toil_{upper\ limit} - 1$; and when $Toil < Toil_{lower\ limit}$, the deviation degree $D_{Toil}$ of the oil temperature superheat degree Toil is calculated according to the following formula: $D_{Toil} = Toil/Toil_{lower\ limit} - 1$; wherein $Toil_{upper\ limit}$ is a maximum value in the standard operating range of the oil temperature superheat degree Toil, and $Toil_{lower\ limit}$ is a minimum value in the standard operating range of the oil temperature superheat degree Toil.

In a preferred embodiment of the above cooling medium control method for the multi-connected air conditioning system, step S130 specifically includes: calculating a total deviation degree $D_{total}$ of the compressor according to the deviation degree $D_{pd}$, the deviation degree $D_{ps}$, the deviation degree $D_c$, the deviation degree $D_{Td}$, and the deviation degree $D_{Toil}$: $D_{total} = W_{pd} * D_{pd} + W_{ps} * D_{ps} + W_c * D_c + W_{Td} * D_{Td} + W_{Toil} * D_{Toil}$; wherein $W_{pd}$, $W_{ps}$, $W_c$, $W_{Td}$ and $W_{Toil}$ are weight values set in advance for the high pressure, low pressure, compression ratio, exhaust superheat degree and oil temperature superheat degree of the compressor respectively; and selectively adjusting the opening degree of the outdoor expansion valve or the indoor expansion valve according to the total deviation degree $D_{total}$.

In a preferred embodiment of the above cooling medium control method for the multi-connected air conditioning system, the step of "selectively adjusting the opening degree of the outdoor expansion valve or the indoor expansion valve according to the total deviation degree $D_{total}$" specifically includes: when $D_{total} > L_{up}$, increasing the opening degree of the indoor expansion valve or the opening degree of the outdoor expansion valve by $P_{ls} = P_{current} * (D_{total} - L_{up})$; when $D_{total} < L_{down}$, decreasing the opening degree of the indoor expansion valve or the opening degree of the outdoor expansion valve by $P_{ls} = P_{current} * (L_{down} - D_{total})$; and when $L_{down} < D_{total} \leq L_{up}$, not adjusting the opening degree of the indoor expansion valve or the outdoor expansion valve; wherein $P_{current}$ is the current opening degree of the indoor expansion valve or the outdoor expansion valve, $L_{up}$ is a preset upper limit threshold of the deviation degree, and $L_{down}$ is a preset lower limit threshold of the deviation degree.

In a preferred embodiment of the above cooling medium control method for the multi-connected air conditioning system, the preset upper limit threshold $L_{up}$ of the deviation degree is 0.1, and the preset lower limit threshold $L_{down}$ of the deviation degree is −0.08; and/or, the total deviation degree $D_{total}$ of the compressor is calculated once every other preset time.

In a preferred embodiment of the above cooling medium control method for the multi-connected air conditioning system, when the multi-connected air conditioning system is operating in a cooling mode, only the opening degree of the indoor expansion valve is adjusted; and when the multi-connected air conditioning system is operating in a heating mode, only the opening degree of the outdoor engine expansion valve is adjusted; and/or, an increase amount of the opening degree of the indoor expansion valve or the outdoor expansion valve does not exceed 5% of the current opening degree of the indoor expansion valve or the outdoor expansion valve; and a decrease amount of the opening degree of the indoor expansion valve or the outdoor expansion valve does not exceed 5% of the current opening degree of the indoor expansion valve or the outdoor expansion valve.

In the present disclosure, the deviation degrees of the target parameters of the compressor are calculated according to the current operating values of the target parameters of the compressor and the standard operating ranges of the target parameters of the compressor; and then the opening degree of the outdoor expansion valve or the indoor expansion valve is selectively adjusted based on the deviation degrees of the target parameters. Specifically, by calculating the total deviation degree of a plurality of target parameters, the opening degree of the outdoor expansion valve or the indoor expansion valve is adjusted so that the circulation amount of the cooling medium of the air conditioning system is dynamically adjusted, thus enabling the compressor to operate in the specified operating ranges of the target parameters and ensuring a stable and reliable operation of the multi-connected air conditioning system.

BRIEF DESCRIPTION OF THE DRAWINGS

FIG. 1 is a main flowchart of a cooling medium control method for a multi-connected air conditioning system according to the present disclosure.

DETAILED DESCRIPTION

In order to make the embodiments, technical solutions and advantages of the present disclosure be more obvious, the technical solutions of the present disclosure will be clearly and completely described below with reference to the accompanying drawings. Obviously, the embodiments as described are some embodiments of the present disclosure, not all of them. It should be understood by those skilled in the art that these embodiments are only used to explain the technical principles of the present disclosure, and are not intended to limit the scope of protection of the present disclosure.

A multi-connected air conditioning system typically includes a compressor, an outdoor unit, and a plurality of indoor units connected to the outdoor unit. The outdoor unit includes an outdoor expansion valve, and each of the indoor units includes an indoor expansion valve. It may be understood by those skilled in the art that the circulation amount of the cooling medium may generally be adjusted by the indoor expansion valve or the outdoor expansion valve. During cooling operation, the opening degree of the indoor expansion valve is adjusted; and during heating operation, the opening degree of the outdoor expansion valve is adjusted. In the present disclosure, the opening degree of the indoor expansion valve or the outdoor expansion valve is adjusted in real time mainly according to the operating parameters of the compressor so that the circulation amount of the cooling medium of the air conditioning system is dynamically adjusted, thus controlling the compressor to operate in a normal range and ensuring a stable and reliable operation of the multi-connected air conditioning system.

Specifically, referring to FIG. 1, a main flowchart of a cooling medium control method for a multi-connected air conditioning system according to the present disclosure is illustrated. As shown in FIG. 1, the cooling medium control method for the multi-connected air conditioning system according to the present disclosure includes the following steps: S110. acquiring current operating values of target parameters of a compressor during the operation of the compressor; S120. calculating deviation degrees of the target parameters of the compressor according to the current operating values of the target parameters of the compressor and standard operating ranges of the target parameters of the compressor; and S130. selectively adjusting an opening degree of an outdoor expansion valve or an indoor expansion valve based on the deviation degrees; wherein the standard operating ranges of the target parameters are operating ranges of the target parameters specified by a normal operating state of the compressor. The cooling medium control method according to the present disclosure will be described in detail below with reference to a specific embodiment.

According to the specification of the compressor, the operating range of the compressor is controlled by a high pressure, a low pressure, a compression ratio, an exhaust superheat degree and an oil temperature superheat degree. In order to ensure the normal operation of the air conditioning system, these parameters must be controlled to be within specified ranges. In actual operation, these parameters affect each other, and the circulation amount of the cooling medium plays a decisive role.

In this embodiment, the target parameters in step S110 may be the high pressure (the current operating value thereof being denoted as Pd), the low pressure (the current operating value thereof being denoted as Ps), the compression ratio (the current operating value thereof being denoted as compRate), the exhaust superheat degree (the current operating value thereof being denoted as Td) and the oil temperature superheat degree (the current operating value thereof being denoted as Toil). For the sake of clarity, the standard operating ranges and parameter descriptions of the above target parameters are shown in Table 1 below:

TABLE 1

| target parameter | standard operating ranges | description of target parameter |
|---|---|---|
| high pressure Pd | 17-38 kg | |
| low pressure Ps | 3-10 kg | |
| compression ratio compRate | 2-8 | compRate = (Pd + 1)/(Ps + 1) |
| exhaust superheat degree Td | 25-60° C. | Td = exhaust temperature − saturation temperature corresponding to high pressure Pd |
| oil temperature superheat degree Toil | 15-50° C. | Toil = oil temperature − saturation temperature corresponding to high pressure Pd |

In step S120, the deviation degree of each of the above target parameters is calculated. It can be understood by those skilled in the art that in the above target parameters, control directions of the high pressure, the low pressure, and the compression ratio are consistent. If the values of the high pressure, the low pressure, and the compression ratio are too large, then the opening degree of the indoor expansion valve or the outdoor expansion valve is decreased, and if the values of the high pressure, the low pressure, and the compression ratio are too small, then the opening degree of the indoor expansion valve or the outdoor expansion valve is increased.

Taking the calculation of the deviation degree of the low pressure as an example, the current operating value of the low pressure of the compressor is Ps; as shown in Table 1, the standard operating range of the low pressure is 3-10 Kg, a maximum value $Ps_{upper\ limit}$ in the standard operating range thereof is 10 kg, and a minimum value $Ps_{lower\ limit}$ in the standard operating range thereof is 3 kg. When $Ps_{lower\ limit} \leq Ps \leq Ps_{upper\ limit}$, the deviation degree $D_{ps}$ of the low pressure is 0; when $Ps > Ps_{upper\ limit}$, the deviation degree $D_{ps}$ of the low pressure is calculated according to the following formula: $D_{ps} = Ps_{upper\ limit}/Ps - 1$; and when $Ps < Ps_{lower\ limit}$, the deviation degree $D_{ps}$ of the low pressure Ps is calculated according to the following formula: $D_{ps} = P_{lower\ limit}/Ps - 1$. For example, when the current operating value of the low pressure of the compressor Ps=11 kg, the deviation degree $D_{ps} = 10/11 - 1 = -0.09$; and when the current operating value of the low pressure of the compressor Ps=2.5 kg, the deviation degree $D_{ps} = 3/2.5 - 1 = 0.2$.

Similarly, the current operating value of the high pressure is Pd; as shown in Table 1, a maximum value $Pd_{upper\ limit}$ in the standard operating range thereof is 38 kg, and a minimum value $Pd_{lower\ limit}$ in the standard operating range thereof is 17 kg. When $Pd_{lower\ limit} \leq Pd \leq Pd_{upper\ limit}$, the deviation degree $D_{pd}$ of the high pressure Pd is 0; when $Pd > Pd_{upper\ limit}$, the deviation degree $D_{pd}$ of the high pressure Pd is calculated according to the following formula: $D_{pd} = Pd_{upper\ limit}/Pd - 1$; and when $Pd < Pd_{lower\ limit}$, the deviation degree $D_{pd}$ of the high pressure Pd is calculated according to the following formula: $D_{pd} = Pd_{lower\ limit}/Pd - 1$.

Similarly, the current compression ratio of the compressor is compRate; as shown in Table 1, a maximum value $C_{upper\ limit}$ in the standard operating range of the compression ratio is 8, and a minimum value $C_{lower\ limit}$ is 2. When $C_{lower\ limit} \leq compRate \leq C_{upper\ limit}$, the deviation degree $D_c$ of the compression ratio is 0; when $compRate > C_{upper\ limit}$, the deviation degree $D_c$ of the compression ratio is calculated according to the following formula: $D_c = C_{upper\ limit}/compRate - 1$; and when $compRate < C_{lower\ limit}$, the deviation degree $D_c$ of the compression ratio is calculated according to the following formula: $D_c = C_{lower\ limit}/compRate - 1$.

It can be understood by those skilled in the art that in the above target parameters, control directions of the exhaust superheat degree Td and the oil temperature superheat degree Toil are consistent. If the exhaust superheat degree Td and the oil temperature superheat degree Toil are too large, then the opening degree of the indoor expansion valve or the outdoor expansion valve is increased, and if the exhaust superheat degree Td and the oil temperature superheat degree Toil are too small, then the opening degree of the indoor expansion valve or the outdoor expansion valve is decreased.

Taking the calculation of the deviation degree of the exhaust superheat degree as an example, the current operating value of the exhaust superheat degree of the compressor is Td; as shown in Table 1, the standard operating range of the exhaust superheat degree is 25-60° C., a maximum value $Td_{upper\ limit}$ in the standard operating range thereof is 60° C., and a minimum value $Td_{lower\ limit}$ in the standard operating range thereof is 25° C. When $Td_{lower\ limit} \leq Td \leq Td_{upper\ limit}$, the deviation degree $D_{Td}$ of the exhaust superheat degree is 0; when $Td > Td_{upper\ limit}$, the deviation degree $D_{Td}$ of the exhaust superheat degree is calculated according to the following formula: $D_{Td} = Td/Td_{upper\ limit} - 1$; and when $Td < Td_{lower\ limit}$, the deviation degree $D_{Td}$ of the exhaust superheat degree Td is calculated according to the following formula: $D_{Td} = Td/Td_{lower\ limit} - 1$. For example, when Td=63° C., $D_{Td} = 63/60 - 1 = 0.05$; and when Td=17° C., $D_{Td} = 17/25 - 1 = -0.32$.

Similarly, the current operating value of the oil temperature superheat degree of the compressor is Toil; as shown in Table 1, the standard operating range of the oil temperature superheat degree is 15-50° C., a maximum value $Toil_{upper\ limit}$ in the standard operating range thereof is 50°

C., and a minimum value $Toil_{lower\ limit}$ in the standard operating range thereof is 15° C. When $Toil_{lower\ limit} \leq Toil \leq Toil_{upper\ limit}$, the deviation degree $D_{Toil}$ of the oil temperature superheat degree is 0; when $Toil > Toil_{upper\ limit}$, the deviation degree of the oil temperature superheat degree Toil is calculated according to the following formula: $D_{Toil} = Toil/Toil_{upper\ limit} - 1$; and when $Toil < Toil_{lower\ limit}$, the deviation degree $D_{Toil}$ of the oil temperature superheat degree is calculated according to the following formula: $D_{Toil} = Toil/Toil_{lower\ limit} - 1$.

In step S130, the step of selectively adjusting an opening degree of the outdoor expansion valve or the indoor expansion valve based on the deviation degrees specifically includes: calculating a total deviation degree $D_{total}$ of the compressor according to the deviation degrees of the above target parameters (i.e., the deviation degree $D_{pd}$, the deviation degree $D_{ps}$, the deviation degree $D_c$, the deviation degree $D_{Td}$, and the deviation degree $D_{Toil}$). $D_{total} = W_{pd} * D_{pd} + W_{ps} * D_{ps} + W_c * D_c + W_{Td} * D_{Td} + W_{Toil} * D_{Toil}$; wherein $W_{pd}$, $W_{ps}$, $W_c$, $W_{Td}$ and $W_{Toil}$ are weight values set in advance for the high pressure, low pressure, compression ratio, exhaust superheat degree and oil temperature superheat degree of the compressor respectively. The weight of each target parameter may be set according to the specifications or recommendations of the compressor manufacturer (Table 2 below gives specific examples of a set of weights). Those skilled in the art may calculate the total deviation degree $D_{total}$ of the compressor once every other preset time, for example, every other 10 seconds or other suitable time interval, and the preset time may be set by those skilled in the art flexibly.

Then, the opening degree of the outdoor expansion valve or the indoor expansion valve is selectively adjusted according to the total deviation degree of the compressor. Specifically, when $D_{total} > L_{up}$, the opening degree of the indoor expansion valve or the opening degree of the outdoor expansion valve is increased by $P_{ls} = P_{current} * (D_{total} - L_{up})$ so as to increase the circulation amount of the cooling medium; when $D_{total} < L_{down}$, the opening degree of the indoor expansion valve or the opening degree of the outdoor expansion valve is decreased by $P_{ls} = P_{current} * (L_{down} - D_{total})$ so as to decrease the circulation amount of the cooling medium; and when $L_{down} \leq D_{total} \leq L_{up}$, the opening degree of the indoor expansion valve or the outdoor expansion valve is not adjusted; wherein $P_{current}$ is the current opening degree of the indoor expansion valve or the outdoor expansion valve, $L_{up}$ is a preset upper limit threshold of the deviation degree, and $L_{down}$ is a preset lower limit threshold of the deviation degree. It should be noted that the preset upper limit threshold $L_{up}$ and the preset lower limit threshold $L_{down}$ of the deviation degree may be set by those skilled in the art through experiments. As an example, the upper limit threshold $L_{up}$ may be set to 0.1, and the lower limit threshold $L_{down}$ may be set to −0.08.

In order to ensure the stability of the air conditioning system without frequent fluctuations, limit values may be set for the adjustment of the opening degrees of the indoor expansion valve and the outdoor expansion valve. For example, the increase amount of the opening degree of the indoor expansion valve or the outdoor expansion valve does not exceed 5% of the current opening degree of the indoor expansion valve or the outdoor expansion valve; and the decrease amount of the opening degree of the indoor expansion valve or the outdoor expansion valve does not exceed 5% of the current opening degree of the indoor expansion valve or the outdoor expansion valve.

As an example, referring to Table 2, the weight of each target parameter and the deviation degree of each target parameter in an embodiment is shown:

TABLE 2

| target parameter | weight | deviation degree |
|---|---|---|
| high pressure | 0.2 | −0.08 |
| low pressure | 0.2 | 0.27 |
| exhaust superheat degree | 0.3 | 0.25 |
| oil temperature superheat degree | 0.15 | 0.08 |
| compression ratio | 0.15 | −0.04 |

When the multi-connected air conditioning system is operating in a cooling mode, only the opening degree of the indoor expansion valve is adjusted. According to the data in Table 2 above, the total deviation degree of the compressor $D_{total} = 0.2*(-0.08) + 0.2*0.27 + 0.3*0.25 + 0.15*0.08 + 0.15*(-0.04) = 0.12$. Since 0.12>0.1 (which is the set upper limit threshold $L_{up}$), the opening degree of the indoor expansion valve needs to be increased. If five indoor units are connected in the multi-connected air conditioning system, the current opening degree of the indoor expansion valve of each indoor unit is $P_{current1} = 115$, $P_{current2} = 120$, $P_{current3} = 132$, $P_{current4} = 108$, and $P_{current5} = 145$; and the opening degree of the indoor expansion valve of each indoor unit is increased by $P_{ls1} = P_{current1} * (D_{total} - L_{up}) = 115*(0.12 - 0.1) \approx 2$, $P_{ls2} = P_{current2} * (D_{total} - L_{up}) = 120*(0.12 - 0.1) \approx 2$, $P_{ls3} = P_{current3} * (D_{total} - L_{up}) = 132*(0.12 - 0.1) \approx 3$, $P_{ls4} = P_{current4} * (D_{total} - L_{up}) = 108*(0.12 - 0.1) \approx 2$, and $P_{ls5} = P_{current5} * (D_{total} - L_{up}) = 145*(0.12 - 0.1) \approx 3$. It should be noted that the increase amount of the opening degree of the indoor expansion valve is rounded to an integer, and the unit of the opening degree of the indoor expansion valve may be one circle, two circles, or other measurement units.

When the multi-connected air conditioning system is operating in a heating mode, only the opening degree of the outdoor expansion valve is adjusted. For example, when the total deviation degree of the compressor $D_{total} = -0.16$, the set lower limit threshold $L_{down}$ is −0.08. Since −0.16<−0.08, the opening degree of the outdoor expansion valve needs to be decreased. If the opening degree of the outdoor expansion valve is 150, the opening degree of the outdoor expansion valve is decreased by $P_{ls} = P_{current} * (L_{down} - D_{total}) = 150*(-0.08 + 0.16) = 12$. Since the decrease amount of the opening degree of the outdoor expansion valve is limited to no more than 5% of the current opening degree, namely, no more than 150*5%=7.5, the integer obtained after rounding is 8. In this case, it is only necessary to decrease the opening degree of the outdoor expansion valve by eight. The unit of the opening degree of the outdoor expansion valve may be one circle, two circles or other measurement units.

As described above, in the present disclosure, the opening degree of the indoor expansion valve or the outdoor expansion valve is adjusted in real time according to the operating parameters of the compressor, so that the circulation amount of the cooling medium of the air conditioning system is dynamically adjusted, thus controlling the compressor to operate in a normal range and ensuring a stable and reliable operation of the multi-connected air conditioning system.

Heretofore, the technical solutions of the present disclosure have been described in connection with the preferred embodiments shown in the drawings, but it can be easily understood by those skilled in the art that the scope of protection of the present disclosure is obviously not limited to these specific embodiments. Those skilled in the art can make equivalent changes or replacements to the related technical features without departing from the principle of the present disclosure. The technical solutions after the modification or replacement will fall within the scope of protection of the present disclosure.

What is claimed is:

1. A cooling medium control method for a multi-connected air conditioning system, the multi-connected air conditioning system comprising a compressor, an outdoor unit, and a plurality of indoor units connected to the outdoor unit, the outdoor unit comprising an outdoor expansion valve, and each of the indoor units comprising an indoor expansion valve, the cooling medium control method comprising the following steps:

S110 acquiring current operating values of target parameters of the compressor during the operation of the compressor;

S120 calculating deviation degrees of the target parameters of the compressor according to the current operating values of the target parameters of the compressor and standard operating ranges of the target parameters of the compressor; and S130 selectively adjusting an opening degree of the outdoor expansion valve or the indoor expansion valve based on the deviation degrees;

wherein the standard operating ranges of the target parameters are operating ranges of the target parameters specified by a normal operating state of the compressor, wherein in step S110, the target parameters comprise a high pressure, a low pressure, and a compression ratio of the compressor, the current operating value of the high pressure being Pd, the current operating value of the low pressure being Ps, and the compression ratio compRate=(Pd+1)/(Ps+1); and in step S120, when $C_{lower\ limit} \leq compRate \leq C_{upper\ limit}$, a deviation degree $D_c$ of the compression ratio is 0;

when $compRate > C_{upper\ limit}$, the deviation degree $D_c$ of the compression ratio is calculated according to the following formula: $D_c = C_{upper\ limit}/compRate - 1$; and when $compRate < C_{lower\ limit}$, the deviation degree $D_c$ of the compression ratio is calculated according to the following formula: $D_c = C_{lower\ limit}/compRate - 1$;

wherein $C_{upper\ limit}$ is a maximum value in the standard operating range of the compression ratio, and $C_{lower\ limit}$ is a minimum value in the standard operating range of the compression ratio.

2. The cooling medium control method for a multi-connected air conditioning system according to claim 1, wherein, in step S120, when $Pd_{lower\ limit} \leq Pd_{upper\ limit}$, a deviation degree $D_{pd}$ of the high pressure Pd is 0;

when $Pd > Pd_{upper\ limit}$, the deviation degree $D_{pd}$ of the high pressure Pd is calculated according to the following formula: $D_{pd} = Pd_{upper\ limit}/Pd - 1$; and when $Pd < Pd_{lower\ limit}$, the deviation degree $D_{pd}$ of the high pressure Pd is calculated according to the following formula: $D_{pd} = Pd_{lower\ limit}/Pd - 1$;

wherein $Pd_{upper\ limit}$ is a maximum value in the standard operating range of the high pressure, and $Pd_{lower\ limit}$ is a minimum value in the standard operating range of the high pressure.

3. The cooling medium control method for a multi-connected air conditioning system according to claim 2, wherein, in step S120, when $Ps_{lower\ limit} \leq Ps_{upper\ limit}$, a deviation degree $D_{ps}$ of the low pressure Ps is 0;

when $Ps > Ps_{upper\ limit}$, the deviation degree $D_p$s of the low pressure Ps is calculated according to the following formula: $D_{ps} = Ps_{upper\ limit}/Ps - 1$; and when $Ps < Ps_{lower\ limit}$, the deviation degree $D_{ps}$ of the low pressure Ps is calculated according to the following formula: $D_{ps} = Ps_{lower\ limit}/Ps - 1$;

wherein $Ps_{upper\ limit}$ is a maximum value in the standard operating range of the low pressure, and $Ps_{lower\ limit}$ is a minimum value in the standard operating range of the low pressure.

4. The cooling medium control method for a multi-connected air conditioning system according to claim 1, wherein, in step S110, the target parameters further comprise an exhaust superheat degree of the compressor, and the current operating value of the exhaust superheat degree is Td; and, in step S120, when $Td_{lower\ limit} \leq Td \leq Td_{upper\ limit}$, a deviation degree $D_{Td}$ of the exhaust superheat degree Td is 0;

when $Td > Td_{upper\ limit}$, the deviation degree $D_{Td}$ of the exhaust superheat degree Td is calculated according to the following formula: $D_{Td} = Td/Td_{upper\ limit} - 1$; and when $Td < Td_{lower\ limit}$, the deviation degree $D_{Td}$ of the exhaust superheat degree Td is calculated according to the following formula: $D_{Td} = Td/Td_{lower\ limit} - 1$;

wherein $Td_{upper\ limit}$ is a maximum value in the standard operating range of the exhaust superheat degree, and $Td_{lower\ limit}$ is a minimum value in the standard operating range of the exhaust superheat degree.

5. The cooling medium control method for a multi-connected air conditioning system according to claim 4, wherein, in step S110, the target parameters further comprise an oil temperature superheat degree of the compressor, and the current operating value of the oil temperature superheat degree is Toil; and, in step S120, when $Toil_{lower\ limit} \leq Toil \leq Toil_{upper\ limit}$, a deviation degree $D_{Toil}$ of the oil temperature superheat degree Toil is 0;

when $Toil > Toil_{upper\ limit}$, the deviation degree $D_{Toil}$ of the oil temperature superheat degree Toil is calculated according to the following formula: $D_{Toil} = Toil/Toil_{upper\ limit} - 1$; and when $Toil < Toil_{lower\ limit}$, the deviation degree $D_{Toil}$ of the oil temperature superheat degree Toil is calculated according to the following formula: $D_{Toil} = Toil/Toil_{lower\ limit} - 1$;

wherein $Toil_{upper\ limit}$ is a maximum value in the standard operating range of the oil temperature superheat degree Toil, and $Toil_{lower\ limit}$ is a minimum value in the standard operating range of the oil temperature superheat degree Toil.

6. The cooling medium control method for a multi-connected air conditioning system according to claim 5, wherein step S130 comprises:

calculating a total deviation degree $D_{total}$ of the compressor according to the deviation degree $D_{pd}$, the deviation degree $D_{ps}$, the deviation degree $D_c$, the deviation degree $D_{Td}$, and the deviation degree $D_{Toil}$:

$$D_{total} = W_{pd} * D_{pd} + W_{ps} * D_{ps} + W_c * D_c + W_{Td} * D_{Td} = W_{Toil} * D_{Toil};$$

wherein $W_{pd}$, $W_{ps}$, $W_c$, $W_{Td}$ and $W_{Toil}$ are weight values set in advance for the high pressure, low pressure, compression ratio, exhaust superheat degree and oil temperature superheat degree of the compressor respectively; and selectively adjusting the opening degree of the outdoor expansion valve or the indoor expansion valve according to the total deviation degree $D_{total}$.

7. The cooling medium control method for a multi-connected air conditioning system according to claim 6, wherein selectively adjusting the opening degree of the outdoor expansion valve or the indoor expansion valve according to the total deviation degree $D_{total}$ comprises:

when $D_{total}>L_{up}$, increasing the opening degree of the indoor expansion valve or the opening degree of the outdoor expansion valve by $P_{ls}=P_{current}*(D_{total}-L_{up})$;

when $D_{total}<L_{down}$, decreasing the opening degree of the indoor expansion valve or the opening degree of the outdoor expansion valve by $P_{ls}=P_{current}*(L_{down}-D_{total})$; and when $L_{down}\leq D_{total}\leq L_{up}$, not adjusting the opening degree of the indoor expansion valve or the outdoor expansion valve;

wherein $P_{current}$ is the current opening degree of the indoor expansion valve or the outdoor expansion valve, $L_{Up}$ is a preset upper limit threshold of the deviation degree, and $L_{down}$ is a preset lower limit threshold of the deviation degree.

8. The cooling medium control method for a multi-connected air conditioning system according to claim 7, wherein the preset upper limit threshold $L_{up}$ of the deviation degree is 0.1, and the preset lower limit threshold $L_{down}$ of the deviation degree is −0.08; and/or the total deviation degree $D_{total}$ of the compressor is calculated once every other preset time.

9. The cooling medium control method for a multi-connected air conditioning system according to claim 1, wherein when the multi-connected air conditioning system is operating in a cooling mode, only the opening degree of the indoor expansion valve is adjusted; and when the multi-connected air conditioning system is operating in a heating mode, only the opening degree of the outdoor engine expansion valve is adjusted; and/or an increase amount of the opening degree of the indoor expansion valve or the outdoor expansion valve does not exceed 5% of the current opening degree of the indoor expansion valve or the outdoor expansion valve; and a decrease amount of the opening degree of the indoor expansion valve or the outdoor expansion valve does not exceed 5% of the current opening degree of the indoor expansion valve or the outdoor expansion valve.

* * * * *